US006968802B1

(12) United States Patent
Mulhern

(10) Patent No.: US 6,968,802 B1
(45) Date of Patent: Nov. 29, 2005

(54) BUOYANT RETRIEVAL OF UNMANNED SEAWATER VEHICLES

(75) Inventor: Francis M. Mulhern, Riverton, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 52 days.

(21) Appl. No.: 10/738,076

(22) Filed: Dec. 18, 2003

(51) Int. Cl.[7] ..... B63B 35/52; B63C 7/18

(52) U.S. Cl. ..... 114/382; 114/44; 114/268; 114/343

(58) Field of Search ..... 114/50–54, 68, 114/69, 345, 354, 360, 365–367, 382, 44, 114/268, 343; 441/6–9, 30–33, 40–42, 80, 441/85

(56) References Cited

U.S. PATENT DOCUMENTS

| | | | | |
|---|---|---|---|---|
| 4,639,229 | A * | 1/1987 | Wright et al. | 441/42 |
| 4,823,325 | A * | 4/1989 | Cole, Jr. | 367/20 |
| 4,995,842 | A * | 2/1991 | Beyer-Olsen | 441/22 |
| 5,374,211 | A * | 12/1994 | Imazato | 441/84 |
| 6,408,782 | B1 * | 6/2002 | Mitchell | 114/360 |

FOREIGN PATENT DOCUMENTS

| | | | | |
|---|---|---|---|---|
| DE | 3910683 | A1 * | 10/1990 | B63B 25/22 |
| EP | 1188662 | A2 * | 3/2002 | B63C 7/02 |
| GB | 2135636 | A * | 9/1984 | B63C 09/02 |
| JP | 05310179 | A * | 11/1993 | B63B 21/66 |
| JP | 05310180 | A * | 11/1993 | B63B 21/66 |
| JP | 06171584 | A * | 6/1994 | B63C 9/02 |
| JP | 2002137790 | A * | 5/2002 | B63C 9/26 |
| JP | 2002234488 | A * | 8/2002 | B63C 7/10 |
| SU | 1463629 | A * | 3/1989 | B63C 07/18 |
| WO | WO 9420361 | A1 * | 9/1994 | B63C 9/26 |

* cited by examiner

*Primary Examiner*—S. Joseph Morano
*Assistant Examiner*—Ajay Vasudeva
(74) *Attorney, Agent, or Firm*—Jacob Shuster

(57) ABSTRACT

An unmanned sea vehicle is provided with a canister storing therein a net assembly in a deflated condition attached to the sea vehicle through the canister by a lanyard in a folded condition. The net assembly is connected to an inflation gas generator through which it is inflated to initiate retrieval of the unmanned sea vehicle. Inflation of the net assembly effects ejection thereof from the canister afloat onto a body of seawater, while connected to the canister on the sea vehicle by the unfolded lanyard. The floating net assembly is thereby positioned for engagement by a grappling hook lowered from a helicopter for example so as to lift it with the sea vehicle suspended therefrom by the lanyard from the sea water surface and transferred to the deck of a retrieval sea vessel.

5 Claims, 4 Drawing Sheets

BUOYANT RETRIEVAL OF UNMANNED SEAWATER VEHICLES

STATEMENT OF GOVERNMENT INTEREST

The invention described herein may be manufactured and used by or for the Government of the United States of America for governmental purposes without the payment of any royalties thereon or therefore.

The present invention relates to retrieval of unmanned vehicles from a body of water.

BACKGROUND OF THE INVENTION

Systems or methods currently provide for retrieval of floating objects or vehicles such as small boats from a body of seawater, involving use of a crane on a retrieval ship from which an attachment device, such as a hook, is lowered into engagement with the floating object to life it from the body of seawater.

Current retrieval systems involve personnel controlled hook attachment to and operator controlled maneuvering of the floating object to be retrieved such as a small boat, in an effort to reduce substantial movement of the floating object relative to the retrieval ship under high sea states caused by sea waves and winds. Such retrieval systems frequently exhibit difficulties in performance of their retrieval functions, which are rendered slow and inefficient.

SUMMARY OF THE INVENTION

It is therefore an important object of the present invention to provide a system for retrieval of small unmanned vehicles from seawater onto the deck of a retrieval ship in a more simple and efficient manner. Toward those ends, the unmanned sea vehicle to be retrieved has a storage canister installed thereon within which a net assembly is stored in a deflated condition connected to a rope or cable lanyard in a folded condition and connected to a gas generator. Such unmanned sea vehicle undergoes retrieval from a location, either afloat on the seawater or submerged therein. Retrieval is initiated by inflation of the net assembly with pressurized gas from the gas generator causing ejection to the net assembly from the storage canister a substantial distance determined by the length of the unfolding lanyard, sufficient to accommodate engagement of the expanded net assembly when afloat on the body of seawater by a grappling hook selectively dropped thereon from a retrieval ship or helicopter. The net assembly is then lifted from the seawater through the grappling hook with the sea vehicle to be retrieved suspended therebelow by its attachment thereto through the lanyard, for transfer onto the deck of the retrieval ship.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
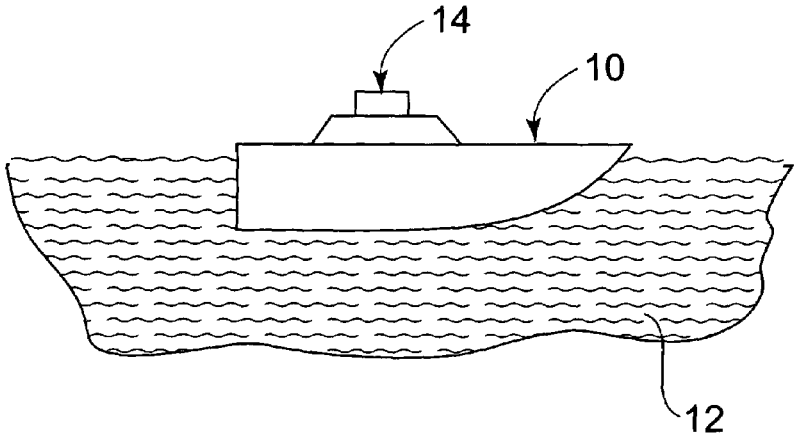
FIG. 1 is a simplified side elevation view of an unmanned sea vehicle to be retrieved afloat on a body of seawater with a storage canister mounted thereon.
Figure 2:
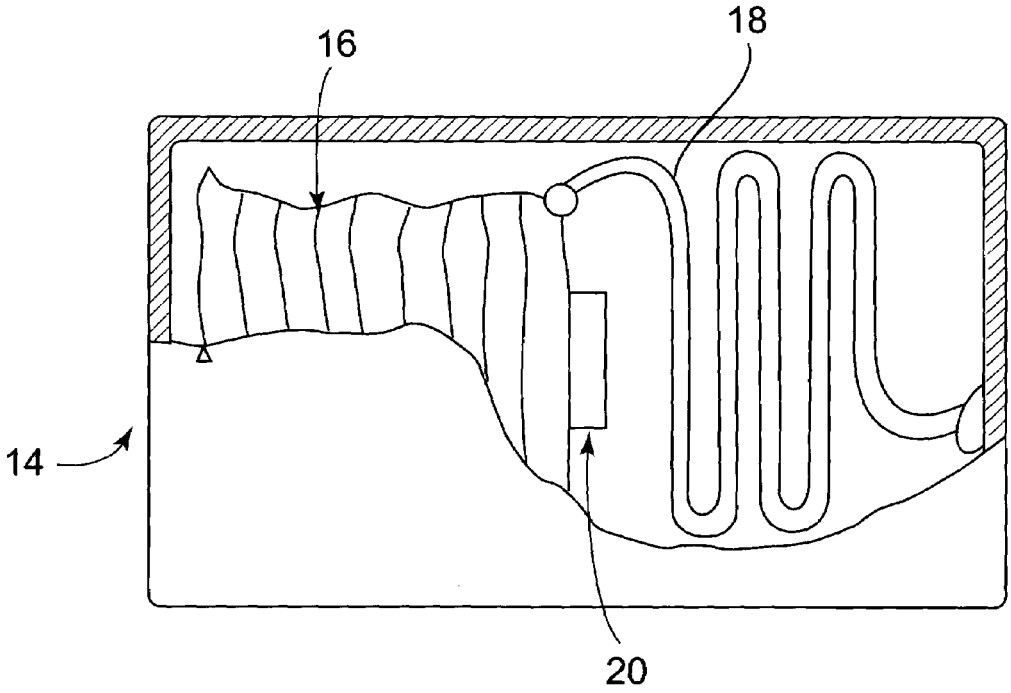
FIG. 2 is a top plan view of the storage canister with a portion thereof broken away to show components of a buoyant retrieval system stored therein.

Referring now to the drawing in detail, FIG. 1 illustrates an unmanned sea vehicle 10 afloat on a body of seawater 12, with a storage canister 14 mounted on the vehicle 10 through which it is to be retrieved pursuant to one embodiment of the present invention. As shown in FIG. 2, the canister 14 encloses and stores therein a buoyant net assembly 16 in a deflated condition. Such deflated net assembly 16 is shown directly connected to a gas cylinder 20 for inflation thereof, and is connected by a rope or cable lanyard 18 in a folded condition to the canister 14. The lanyard 18 maintains the net assembly 16 attached to the canister 14 when injected from the canister 14 by inflation with pressurized gas from the gas cylinder 20. When the net assembly 16 is fully inflated as shown in FIGS. 3 and 4, it acts as an inflated life raft floating on the body of seawater 12 and attached by the unfolded lanyard 18 to the sea vehicle 10 through the canister 14.

The net assembly 16 includes an outer tube ring 22 attached to the lanyard 18. Such ring 22 is formed from a tube inflated to a diameter (d) of 6–12 inches for example so as to extend into its overall ring shape of approximately 20 to 30 feet in length (l) as shown in FIG. 4. Suspended inside the ring 22 is netting 24 of a strength sufficient to support the weight of the vehicle 10 when suspended therebelow by the lanyard 18 which is also of sufficient strength for such purpose as hereinafter explained.

Figure 3:
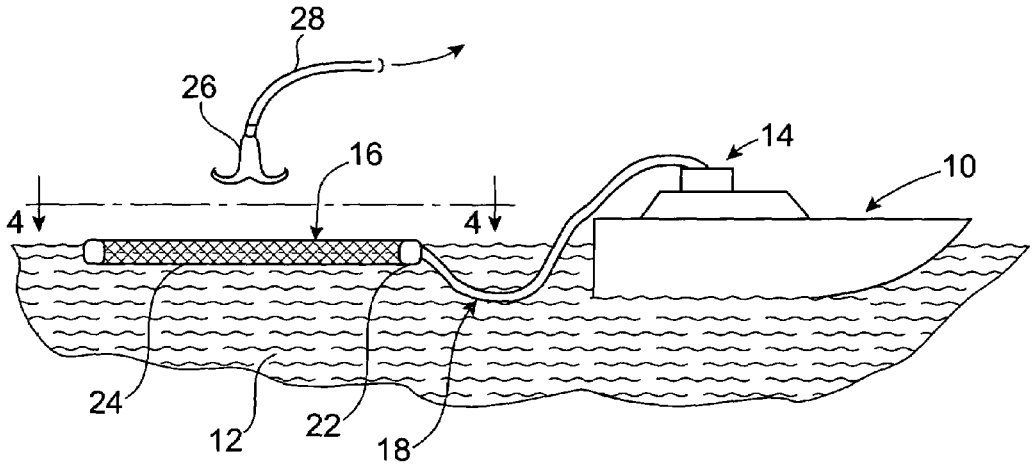
FIG. 3 is a simplified side elevation view of the buoyant retrieval system components afloat on the body of seawater adjacent the unmanned sea vehicle after inflation and ejection from the canister, with a grappling hook being lowered onto the net assembly component.
Figure 4:
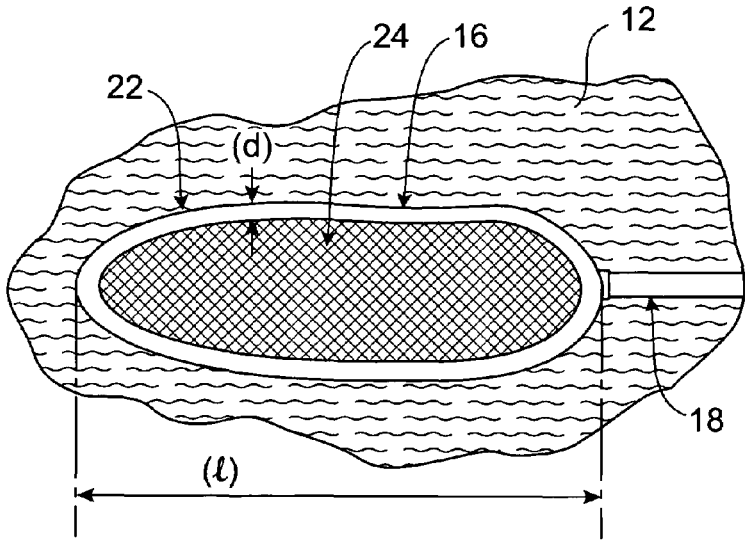
FIG. 4 is a partial top plan view as seen from section line 4—4 in FIG. 3, showing the net assembly component in its inflated condition afloat on the body of seawater.
Figure 5:
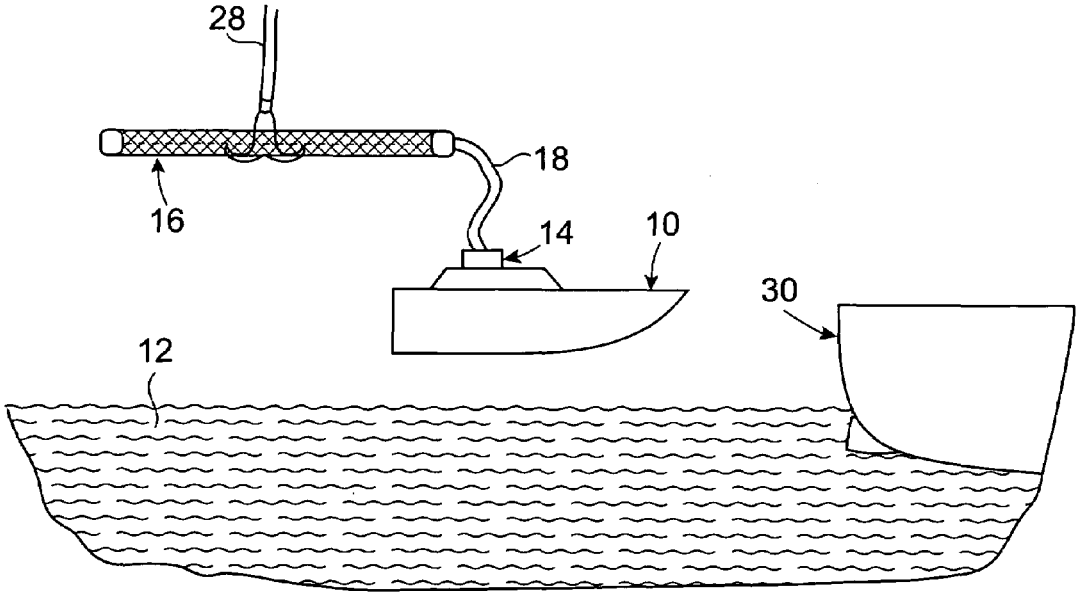
FIG. 5 is a side elevation view showing the hook-lifted unmanned sea vehicle being transferred toward a retrieval ship afloat on the body of seawater.
Figure 6:
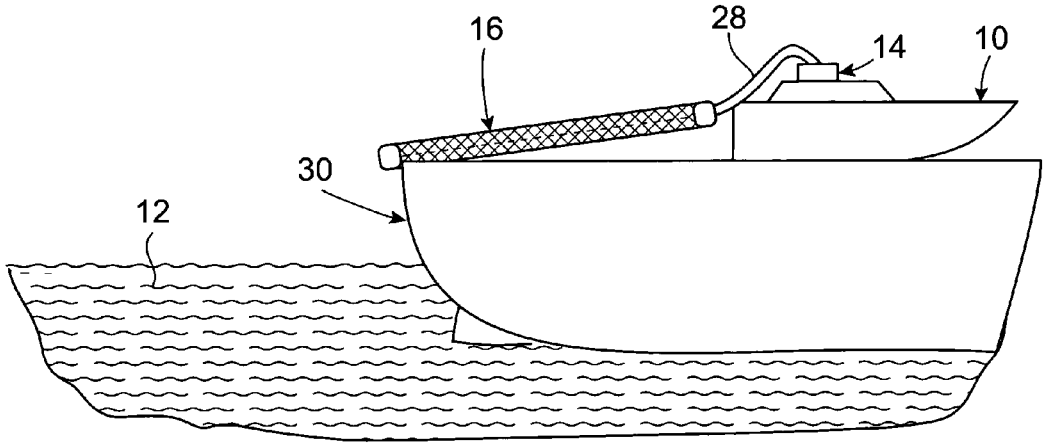
FIG. 6 is a side elevation view of the retrieved unmanned sea vehicle on the deck of the retrieval ship.

The lanyard 18 is long enough to allow the inflated net assembly 16 to float on the surface of the body of seawater 12 spaced from the unmanned vehicle 10 with clearance as shown in FIG. 3. The floating net assembly 16 has a low flexible profile to provide a large target for a grappling hook 26 shown being lowered onto the net assembly 16 by a cable 28 from a suitable location thereabove such as a ship deck, a crane, a harpoon gun or a helicopter. Once the grappling hook 26 engages the netting 24 of the net assembly 16, it lifts the net assembly 16 through the cable 28 with the unmanned vehicle 10 suspended therefrom by the lanyard 18 as shown in FIG. 5. The vehicle 10 is thereby deposited onto the deck of a retrieval ship 30 as shown in FIG. 6.

Figure 3A:
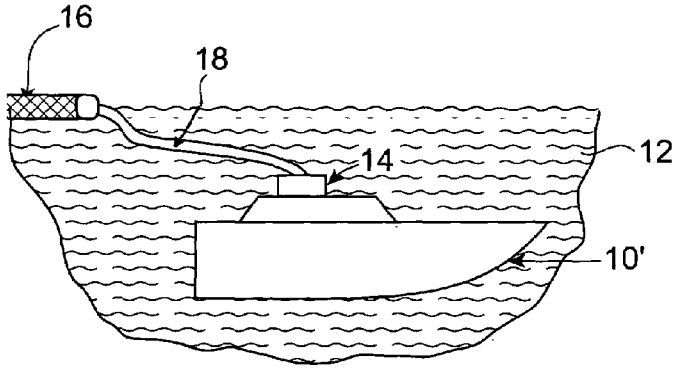
FIG. 3A is a partial side elevation view corresponding to that of FIG. 3, but showing the unmanned sea vehicle submerged in the body of seawater rather than afloat thereon as shown in FIGS. 1 and 3.

According to another embodiment as illustrated in FIG. 3A, the canister 14 is positioned on a submerged vehicle 10', from which the net assembly 16 is deployed and floats onto the surface of the body of seawater 12. The deployed net assembly 16 may then be engaged by the grappling hook 26 to lift the vehicle 10' out of the body of seawater 12 for deposit onto the retrieval ship 30. Thus, the submerged type of unmanned vehicle 10' may be retrieved from its underwater location without surfacing before grappling hook 26 is lowered into engagement with the floating net assembly 16 to lift it from the seawater surface with the sea vehicle 10' suspended therebelow by the lanyard 28.

It will therefore be apparent from the foregoing description that the floating unmanned vehicle 10 or the underwater vehicle 10' may be retrieved from the body of seawater 12 in low or high sea states, by lowering of the grappling hook 26 onto a relatively large area of the netting 24 when the net assembly 16 is deployed without effecting attachments after such deployment of the net assembly 16 in its inflated condition.

Obviously, other modifications and variations of the present invention may be possible in light of the foregoing teachings. It is therefore to be understood that within the scope of the appended claims the invention may be practiced otherwise than as specifically described.

What is claimed is:

1. A retrieval system of an unmanned vehicle for retrieval of the vehicle from a body of seawater by lifting of the vehicle from the body of seawater and transfer thereof to a retrieval location, comprising: inflatable netting; storage means for storing the netting in a deflated condition on the vehicle; deployment means for inflation of the deflated netting causing ejection thereof from the storage means and floatation on said body of seawater; and grappling hook means lowered from the retrieval location directly engaging the inflated netting afloat on the body of seawater to effect said lift of the vehicle suspended from the netting during said transfer to the retrieval location.

2. The system as defined in claim 1, wherein said retrieval location is on a deck of a retrieval ship on the body of seawater.

3. The system as defined in claim 2, wherein said deployment means comprises: a source of pressurized inflation gas within the storage means; and lanyard means interconnecting said netting with the unmanned vehicle while suspended therefrom during said lifting of the vehicle and transfer to the retrieval ship.

4. The system as defined in claim 1, wherein said deployment means comprises: a source of pressurized inflation gas within the storage means; and lanyard means interconnecting said netting with the unmanned vehicle while suspended therefrom during said transfer thereof to the retrieval location.

5. A method for retrieving an unmanned sea vessel from a body of seawater onto a deck of a retrieval ship, comprising the steps of: storing inflatable netting in a deflated condition attached to and in a position on the sea vessel; inflating the netting for ejection from said position on the sea vessel onto the body of seawater; directly engaging the ejected netting floating on the body of seawater with a grappling hook; and lifting the inflated netting with the sea vessel attached thereto and depositing onto the deck of the retrieval ship.

* * * * *